United States Patent [19]

Armstrong

[11] 4,304,400

[45] Dec. 8, 1981

[54] MANUALLY POWERED AMUSEMENT DEVICE

[76] Inventor: W. Ted Armstrong, P.O. Box 40962, San Francisco, Calif. 94140

[21] Appl. No.: 135,612

[22] Filed: Mar. 28, 1980

[51] Int. Cl.[3] ..... A63G 1/20

[52] U.S. Cl. ..... 272/33 R; 272/51

[58] Field of Search ..... 272/33 R, 33 A, 33 B, 272/50, 51, 46, 36, 1 R; 280/282, 281, 87.01, 226 R, 226 A

[56] References Cited

U.S. PATENT DOCUMENTS

| | | | |
|---|---|---|---|
| 1,454,991 | 5/1923 | Williams | 272/33 R |
| 1,466,476 | 8/1923 | Mankey | 272/33 R |
| 2,193,154 | 3/1940 | Antinori | 272/51 X |
| 2,423,590 | 7/1947 | Fagoel | 280/282 X |
| 2,696,387 | 12/1954 | Nordin | 280/282 X |
| 2,862,710 | 12/1958 | Lewis | 272/50 X |
| 2,920,889 | 1/1960 | Keeling | 272/50 X |
| 3,062,559 | 11/1962 | Hewitt | 280/282 X |
| 3,197,202 | 7/1965 | Tieman | 272/33 R |

*Primary Examiner*—Richard C. Pinkham
*Assistant Examiner*—Arnold W. Kramer
*Attorney, Agent, or Firm*—Washington Patent Office Searches

[57] ABSTRACT

A rider actuated amusement device comprises a base which at one end includes a transverse crossbar supported on swivel casters. A shaft which is downwardly inclined toward the opposite end of the base is axially secured but rotatably free in a bearing of the base. A circular disc is fixed on the lower end of the shaft, the disc and swivel casters forming a three point support for the device. A transverse handlebar extends through the upper end of the shaft. A mounting member fixedly secured to the shaft between the handlebar and base bearing has a seat on the upper portion close to the shaft and a downwardly dependent portion extending below the shaft and having a foot rest bar for the rider's feet, whereby the rider shifting his weight to either side causes the disc to roll a short distance and the casters to move so that the location of the device with respect to the ground or supporting surface changes.

1 Claim, 2 Drawing Figures

MANUALLY POWERED AMUSEMENT DEVICE

This invention relates to recreational devices, and more particularly to, a manually powered amusement device.

It is therefore the principal object of this invention to provide a manually powered amusement device, which will be a novel form of recreation, that is simple to operate.

Another object of this invention is to provide a manually powered amusement device, which will be challenging and entertaining to the users.

Another object of this invention is to provide a manually powered amusement device, which will be mounted by the user, and upon the user leaning his or her upper torso, right or left, the device will move in an orbit like fashion, upon the ground or other surface.

A further object of this invention is to provide a manually powered amusement device, which will be safe in use.

Other objects are to provide a manually powered amusement device, which is simple in design, inexpensive to manufacture, rugged in construction, easy to use, and efficient in operation.

Figure 1:
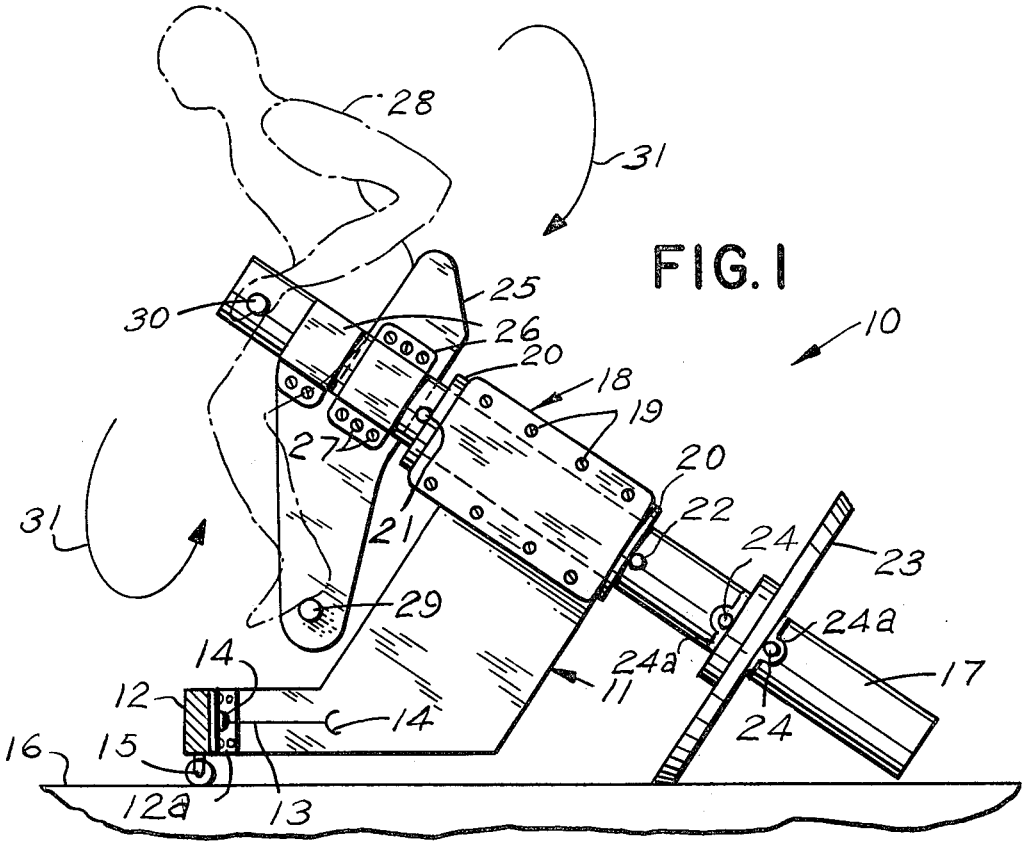
Figure 2:
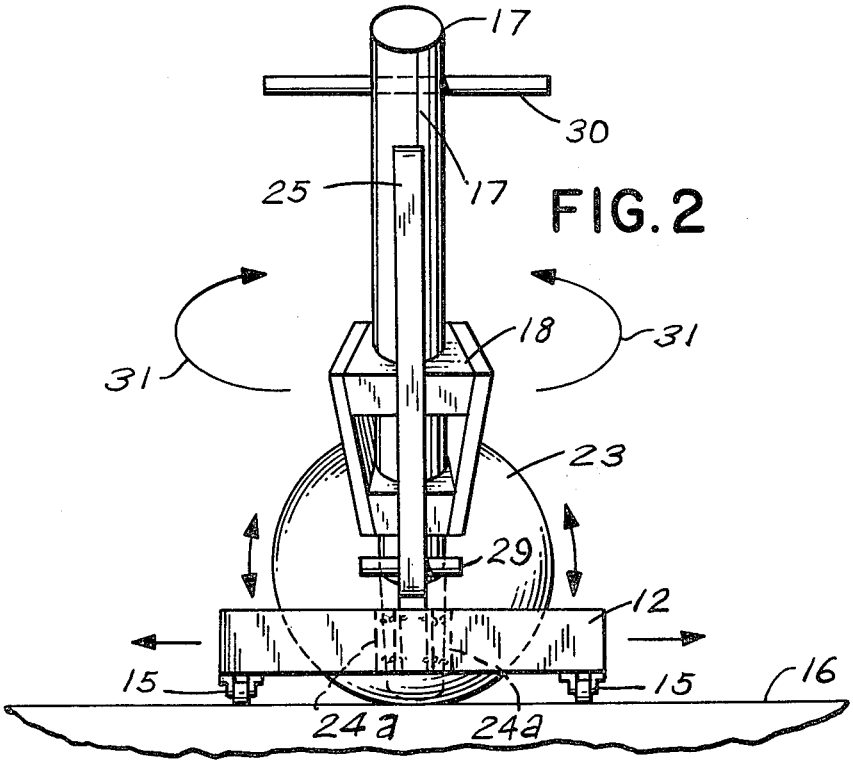

These, and other objects, will be readily evident, upon a study of the following specification, and the accompanying drawing, wherein:

FIG. 1 is a side view of the present invention, shown partly broken away, and illustrate a rider in phantom, and FIG. 2 is a fragmentary front view of FIG. 1.

According to this invention, device 10 is shown to include a base 11, having a cross-bar 12 fixedly secured to its front, by suitable brackets 12*a*. Base 11 further includes a cable 13, which is attached to eyes 14 of base 11 and the cross-bar 12, on both sides for maximum strength. A pair of spaced apart swivel castors 15 are secured to the bottom of crossbar 12, for rolling engagement with the ground 16 or other surface, and a shaft or pole 17 is freely rotatable in a bearing 18, which is secured to the upper portion of base 11, by means of suitable fasteners 19. A pair of washers 20 on shaft 17 abut with transverse pins 21 and 22 of shaft 17, so as to keep shaft 17 in proper position, and a disc 23 is secure fixedly on shaft 17, between transverse pins 24 and pillow blocks 24*a* thereof, and disc 23 is in rolling engagement with ground 16.

A mounting member 25 is secured by brackets 26 to the upper end of shaft 17, by means of suitable fasteners 27, so as to support the rider 28, and a foot rest bar 29 is secured in mounting member 25 at its lower end, above the forward portion of base 11. A handle bar 30 is secured transversely in the upper portion of shaft 17, so as to enable the rider 28 to grasp it, for shifting his or her upper torso right or left as is indicated by the arrows 31. When the rider 28 constantly shifts his or her weight as was heretofore described, device 10 will move in an orbital manner, upon ground 16.

As clearly shown in FIG. 1, the end of the mounting member having the foot rest 29 extends a longer distance from the shaft axis than the distance of the rider's seat from the shaft axis, so that normally the longer end being presumably heavier, always pendulates downwardly. However, the torso of the rider seated upon the mounting member is higher than the shaft axis, and the weight thereof together with the seat almost counterbalances the mounting member lower end, so that by shifting his weight either toward a right or left, the rider is able to tilt the mounting member sufficiently enough so as to cause the disc to roll a short distance across the ground, and which will be adequate so as to cause either of the two casters to move upon the ground, thus shifting the location of the device 10 upon the ground. The counterbalance combined weight of the rider's torso and the seat, however, is always less than the mounting member lower end so that after the tilting action, the mounting member again swings to right itself back to its original position. However, the location of the device 10 upon the ground, does not necessarily return back to its original position because the same casters may possibly not turn exactly the same in a reverse direction, so that the device thus may have travelled to a new location.

While various changes may be made in the detail construction, it is understood that such changes will be within the spirit and scope of the present invention, as is defined by the appended claims.

What I now claim is:

1. A manually powered amusement device, comprising, in combination, a base which at one end includes a transverse crossbar which at its opposite ends is supported upon a pair of spaced-apart swivel casters, a downwardly inclined shaft into a direction toward an opposite end of said base being axially secured but rotatably free in a bearing of said base, a circular disc affixed on a projecting lower end of said shaft, said disc and said pair of swivel casters providing a three point support of said device upon any horizontal surface; an upwardly opposite projecting end of said shaft being fitted with a transverse handlebar therethrough, and a mounting member fixedly secured to said shaft between said handlebar and said base bearing, said mounting member providing seating means thereupon relatively close to said shaft for a rider of said device and an elongated, opposite extending portion of said mounting member having a foot rest bar for said rider.

* * * * *